United States Patent [19]

Poulain Ricros

[11] 4,456,319

[45] Jun. 26, 1984

[54] APPARATUS FOR SECURING ELECTRICAL CONNECTORS

[76] Inventor: André Poulain Ricros, Avenida Diagonal, 381, Barcelona 8, Spain

[21] Appl. No.: 341,132

[22] Filed: Jan. 20, 1982

[30] Foreign Application Priority Data

Jan. 23, 1981 [ES] Spain ..... 256.161

[51] Int. Cl.[3] ..... H01R 13/621

[52] U.S. Cl. ..... 339/92 R; 339/92 M

[58] Field of Search ..... 339/92 R, 92 M; 411/352, 353, 337, 315, 316, 317

[56] References Cited

U.S. PATENT DOCUMENTS

| | | | |
|---|---|---|---|
| 85,794 | 1/1869 | Crosby | 411/87 |
| 3,082,398 | 3/1963 | Valach | 339/92 M |
| 3,221,794 | 12/1965 | Acres | 411/353 |
| 3,555,491 | 1/1971 | Moss | 339/92 R |

*Primary Examiner*—John McQuade
*Attorney, Agent, or Firm*—Steinberg & Raskin

[57] ABSTRACT

Apparatus for securing an electrical connection box which houses a first electrical connector to a second electrical connector which has been plugged into the first connector includes at least one rod mounted in a respective bore formed in the connection box so as to be freely rotatable therein and wherein each rod has a first end which projects from the connection box having a head accessible for rotating the rod and a second end constituting a threaded stud adapted to be threadedly connected to a nut fixed to the second electrical connector. The rod is free to be axially displaced within the bore to a limited extent thereby permitting the electrical connection of the connectors to be made prior to securing the same to each other.

2 Claims, 5 Drawing Figures

APPARATUS FOR SECURING ELECTRICAL CONNECTORS

BACKGROUND OF THE INVENTION

This invention relates to apparatus for securing or fastening electrical connection boxes and is particularly adapted to secure multiple connections which comprise a movable connector constituting a group of connectors and a fixed connector mounted on apparatus which comprises electrical circuits which correspond to respective conductors. The pair of connectors generally are formed with complementary male and female configurations to facilitate their coupling and in which are accommodated male and female type terminals, respectively, for electrical connection.

This type of multiple electrical connector is commonly employed in various electrical and electronic apparatus and has as its basic function to accomplish a plurality of connections in a relatively small space.

SUMMARY OF THE INVENTION

It is the main object of the present invention to provide new and improved apparatus for avoiding accidental disconnection of the connectors.

Another object of the present invention is to provide such disconnection prevention apparatus which is relatively simple in construction and easy to operate.

Briefly, in accordance with the present invention, these and other objects are attained by providing securement apparatus including rods mounted in bores formed in an insulating connection box or housing, which rods are freely rotatable within the bores and are capable of a limited axial displacement therewithin. One end of each rod projects from the connection box so as to be externally accessible to allow for manipulation of the rod, and the other end is threaded so as to be adapted to be screwed into a corresponding internally threaded member mounted on a fixed part of the other electrical connector.

More particularly, the axially slideable rods move through bores formed in the insulating connection box of the movable electrical connector and have a projecting member associated therewith in the region situated within the bore which can move with a degree of play within the interior of a guide seat formed in the connection box thereby determining the limited extent to which the rod can be displaced.

In the illustrated preferred embodiment, the rods are formed with respectively annular grooves in the region situated within the bore of the connector box. An elastic Ω-shaped clip is fitted in a respective groove of each rod. Each clip has arms which extend laterally from the rod and terminate in relatively bent flanges which ride on step guides provided in a slot which communicates with the rod bore and extends substantially parallel thereto.

According to another feature of the invention, the rods may be provided with means for passing a strapping wire therethrough to rotatably fix the rods to thereby avoid accidental disconnection of the electrical connectors.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENT

Figure 1:
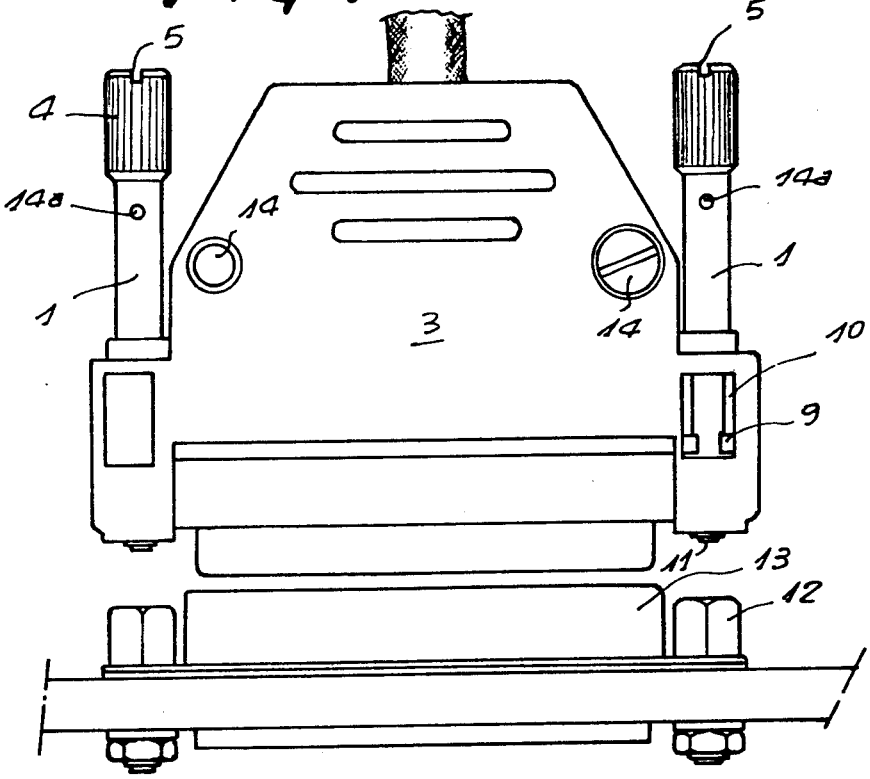
FIG. 1 is a front elevation view of apparatus according to the present invention.

Referring now to the drawings wherein like reference characters designate identical or corresponding parts throughout the several views, the apparatus of the present invention is illustrated for use in connection with securing an electrical connection box 3 which houses a first electrical connector to a second electrical connector, designated 13. In the illustrated embodiment, the fastening apparatus includes two rods 1 mounted for limited axial displacement and for free rotation within respective bores 2 formed in the insulating connector box 3 in the interior of which one of the electrical connectors is housed. It is understood that the number of rods 1 may vary within the scope of the present invention.

One of the ends of each of the rods 1 projects from the connection box 3 and terminates in a head 4, preferably having a slot 5 formed therein so that the rod 1 can be rotated by means of a screwdriver.

An annular groove or recess 6 is formed in each of the rods 1 at an area thereof which is situated within a respective bore 2.

Figure 4:
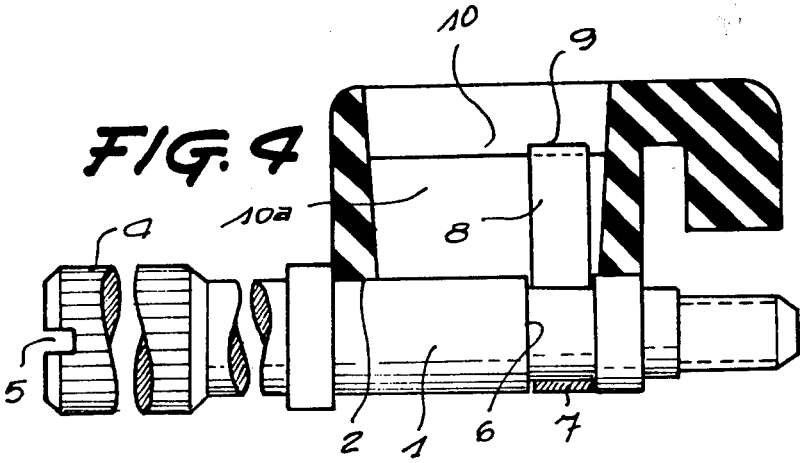
FIG. 4 is a sectional view taken through a transverse plane in FIG. 3.
Figure 2:
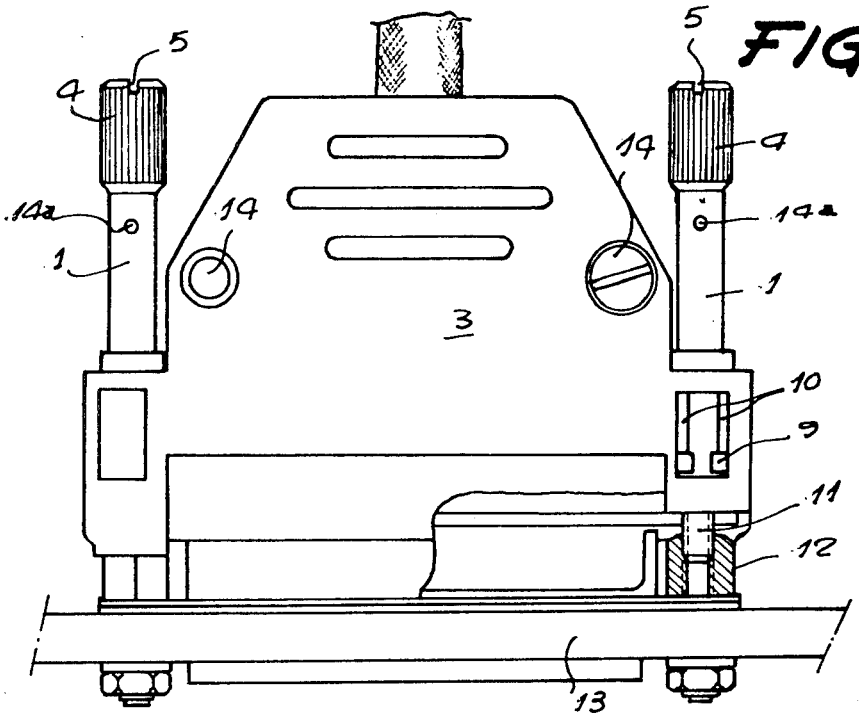
FIG. 2 is a view similar to FIG. 1 and illustrating the electrical connectors in their connected positions, and being partly sectioned in a zone wherein the threaded stud end of the rod is threadedly connected to a corresponding nut fixed to the other connector.
Figure 5:
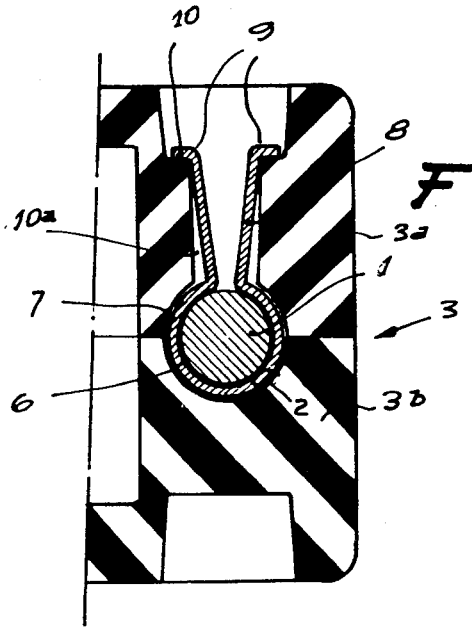
FIG. 5 is a sectional view taken along line V—V of FIG. 3.
Figure 3:
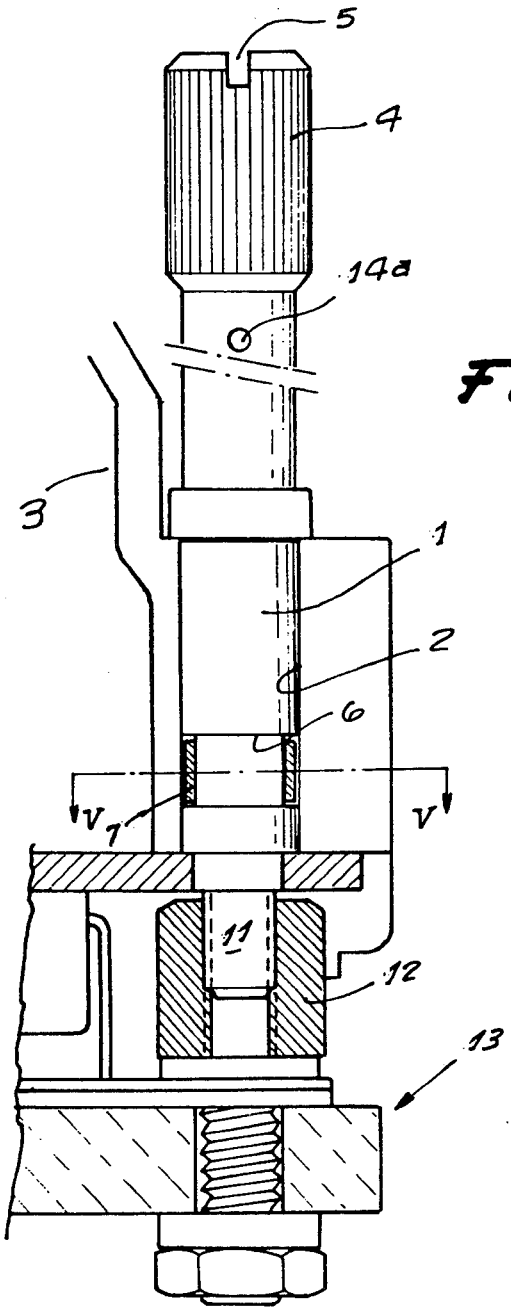
FIG. 3 is a elevation view in partial section illustrating a portion of the apparatus shown in FIG. 2.

Referring to FIGS. 4 and 5, a slot **10*a* is formed in the connection box which extends substantially parallel to and communicates with a respective bore 2. Each slot 10*a* terminates in stepped guides 10. The stepped guides 10 are shorter than the length of bore 2** and, as discussed below, serve to limit the axial displacement of the rod within the bore.

According to the illustrated embodiment, an Ω-shaped clip member 7 is fitted within the annular groove 6 of a respective rod 1. The clip member 7 has elastic arms 8 which extend from the clip 7 through the slot **10*a* and terminate in relatively small bent flanges 9 which are situated on the stepped guides 10 provided in the slots 10*a* of the connection box 3. It is seen from the foregoing that the axial displacement of the rod 1 within bore 2 is limited through the abutment of the terminal flanges 9 and the ends of the stepped guides 10**.

The end of each rod 1 which is opposite from the head 4 externally projects from the bore 2 and is constituted by a threaded stud 11 which is adapted to be threadedly connected into an internally threaded member, such as nut 12, associated with the other electrical connector 13.

It is further noted that the insulated connection box 3 is preferably formed in substantially identical half portions **3*a* and 3*b* which are joined to each other by means of screws 14**.

The securing apparatus of the present invention operates as follows. The first and second electrical connectors are first located in facing relationship whereupon the rods 1 are manually rotated through manipulation of the heads 4 whereupon the studs 11 are screwed to the nuts 12 thereby bringing the connection box 3 close to the fixed connector 13 whereupon the male and female terminals of the two connectors are plugged together with any possible accidental separation being prevented.

As noted above, the connection of the studs can be accomplished by the aid of a screwdriver or may be accomplished using any other suitable tool according to the particular configuration of the head 4.

The construction of the apparatus described above provides important advantages. More particularly, since the rods 1 are capable of axially sliding within the bores 2, the first electrical connector housed within connection box 3 can first be plugged into the second connector 13, the rods 1 being pushed upwardly during the electrical connection process. After accomplishing this step, the connection box 3 can be secured mechanically to the connector 13 by screwing the threaded stud 11 into the nut 12 as described above. In this manner, a secure and rigid mechanical connection is assured while at the same time avoiding any stresses which might be exerted on the cable or connection box 3.

On the other hand, the clip members 7 act as stops to prevent the rods 1 from becoming removed from the bores 2.

In order to unlock the connection, the process described is merely reversed while making sure that the studs 11 are completely unscrewed from the nuts 12 without acting on the connection box 3. The first and second connectors will remain plugged to each other during the unscrewing operation due to the axial movement of the rods which is limited by the length of the slots 10*a* in which the clip member arms 8 slide with the bent flanges 9. For this reason, the final unplugging of the electrical connectors will occur after the rods have been disconnected from the nuts and will take place in a uniform manner without any possible binding due to unlevel movement of the connection box which occurs in conventional arrangements wherein rods do not have the axial play which is a characteristic feature of the present invention.

In order to avoid the possibility of inadvertent separation of the electrical connectors or of a splicing of the cables with the contacts in the interior of a connector, openings 14*a* are formed in rods 1 through which a strap wire may be passed in order to strap the connector after the same has been plugged.

Obviously, numerous modifications and variations of the present invention are possibility in the light of the above teachings. It is therefore to be understood that within the scope of the claims appended hereto, the invention may be practices otherwise than as specifically disclosed herein.

What is claimed is:

1. Apparatus for securing an electrical connection box housing a first electrical connector, to a second electrical connector, comprising:

an electrical connection box having at least one bore formed therein;

at least one rod mounted in a respective bore formed in said electrical connection box so as to be freely rotatable therein, said rod having an annular groove formed therein, a first end projecting externally of said connection box and having a head accessible for rotating said rod, and a second end constituting a threaded stud adapted to be threadedly connected to an internal threaded member fixed to the second electrical connector; and means for limiting the extent of axial displacement of said rod within said respective bore, which comprises:

guide means formed in said connection box in communication with said respective bore in which said rod is mounted and extending substantially parallel to said bore for a length which is shorter than the length of the bore in which said rod is mounted; and a substantially Ω-shaped clip member mounted within said groove so as to be axially fixed and freely rotatable with respect to said rod, and having arms which extend laterally from said rod, pass into said guide means, and terminate at bent flanges adapted to run along said guide means.

2. The combination of claim 1 wherein said rod is provided with means for passing a strapping wire therethrough to rotatably fix said rod to avoid any separation or accidental disconnection of said electrical connection.

* * * * *